US007121127B1

(12) United States Patent
Fan

(10) Patent No.: US 7,121,127 B1
(45) Date of Patent: Oct. 17, 2006

(54) LOCK SET WITH A QUICK CHANGEABILITY

(75) Inventor: Fang-Chang Fan, Chia-Yi (TW)

(73) Assignee: Eversafety Precision Industry (Tianjin) Co., Ltd., Tianjin (CN)

( * ) Notice: Subject to any disclaimer, the term of this patent is extended or adjusted under 35 U.S.C. 154(b) by 0 days.

(21) Appl. No.: 11/305,403

(22) Filed: Dec. 16, 2005

(51) Int. Cl.
*E05B 9/04* (2006.01)

(52) U.S. Cl. ..... 70/373; 70/372; 70/367; 70/370; 70/371; 70/493

(58) Field of Classification Search ..... 370/370–373, 370/375, 382–385, 493, 367, 378, 358
See application file for complete search history.

(56) References Cited

U.S. PATENT DOCUMENTS 2,977,786 A * 4/1961 Kendrick et al. ..... 70/493
4,294,092 A * 10/1981 Haggstrom ..... 70/493
6,810,703 B1 * 11/2004 Huang et al. ..... 70/373
6,935,146 B1 * 8/2005 Lin ..... 70/338
6,951,123 B1 * 10/2005 Chong ..... 70/493
2005/0072199 A1 * 4/2005 Edwards, Jr. ..... 70/493

* cited by examiner

*Primary Examiner*—Brian E. Glessner
*Assistant Examiner*—William Schrode
(74) *Attorney, Agent, or Firm*—William E. Pelton, Esq.

(57) ABSTRACT

A lock set with a quick changeability has a plug, a cylinder, a seat, a ring and a sliding cover. The plug is mounted in the cylinder and has multiple first holes in rows wherein multiple lower pins are inserted. The cylinder has a chamber radially defined therein wherein the plug is inserted, and a lug formed in a top end thereof. Multiple second holes in rows are respectively defined in the lug and multiple upper pins and springs are inserted into the second holes. Multiple openings in rows are respectively defined in a lower inner wall of the cylinder wherein upper pins and springs are inserted into the second holes. The sliding cover abuts the lower inner wall of the chamber and has multiple orifices in rows defined therein. Hence, it is easy for a user to change a corresponding key.

5 Claims, 4 Drawing Sheets

LOCK SET WITH A QUICK CHANGEABILITY

BACKGROUND OF THE INVENTION

1. Field of the Invention

The present invention relates to a lock set with a quick changeability, and more particularly to a lock set which is easy to change a corresponding key.

2. Description of the Related Art

A first conventional lock set is composed of a key, a hollow cylinder, a barrel-like seat and a hollow plug. The seat has a cutout 90 degrees in arc length in a free end thereof and multiple holes in alignment are respectively defined in a periphery thereof. The cutout is flush with the holes. The plug has a keyway defined in an axial direction thereof and multiple openings in alignment respectively defined in a periphery thereof. A latch is radially inserted into a free end of the plug and 90 degrees relative to the openings. Multiple pins are respectively inserted into the openings.

The seat is securely mounted in the cylinder and plug is inserted into the seat. The latch is received into the cutout so that the plug can only rotate relative to the seat 90 degrees and the pins can only rotate in the plug. When the latch is separated with the plug, the plug can rotated in the seat freely. When the openings respectively aim to the holes, the pins can be taken out of the plug for renewing.

However, the latch should be taken out of the plug and reassembled for changing new pins thereby generating an in convenient assembling process.

A second conventional lock set comprises a key, a hollow cylinder, and a plug. The cylinder has multiple first holes in a row defined in a first periphery thereof and multiple openings in a row defined in a second periphery thereof and opposite to the first holes. Multiple first pins and springs are respectively inserted into the first holes. A first positioning hole is defined in the first periphery of the cylinder and in alignment with the first holes while a second positioning hole is defined in the second periphery of the cylinder and in alignment with the openings. The plug has multiple second holes are respectively defined in a periphery thereof and a keyway is radially defined therein. A third positioning hole is defined in the periphery of the plug and multiple second pins are respectively inserted into the second holes. A ball and a coil spring are inserted into the first and the third positioning hole.

A seat is securely mounted in the cylinder while the plug is inserted into the seat and can only be pivoted relative to the cylinder. When the key is inserted into the keyway and rotates 180 degrees, the plug is driven to rotate and the ball is inserted into the second positioning hole so that the second holes aim to the openings and the first and the second pins can be taken out of the cylinder for renewing.

However, when the plug is rotated to the cylinder, the ball is easy to damage by rotation in the plug. Furthermore, the first and the second positioning holes can be expanded and distorted by the friction of the ball such that the second holes cannot be accurately aimed to the openings.

Therefore, the invention provides a lock set with quick changeability to mitigate or obviate the aforementioned problems.

SUMMARY OF THE INVENTION

The main objective of the present invention is to provide a lock set with a quick changeability, a corresponding key of which can easily be changed for renewing Other objectives, advantages and novel features of the invention will become more apparent from the following detailed description when taken in conjunction with the accompanying drawings.

DETAILED DESCRIPTION OF THE PREFERRED EMBODIMENT

Figure 1:
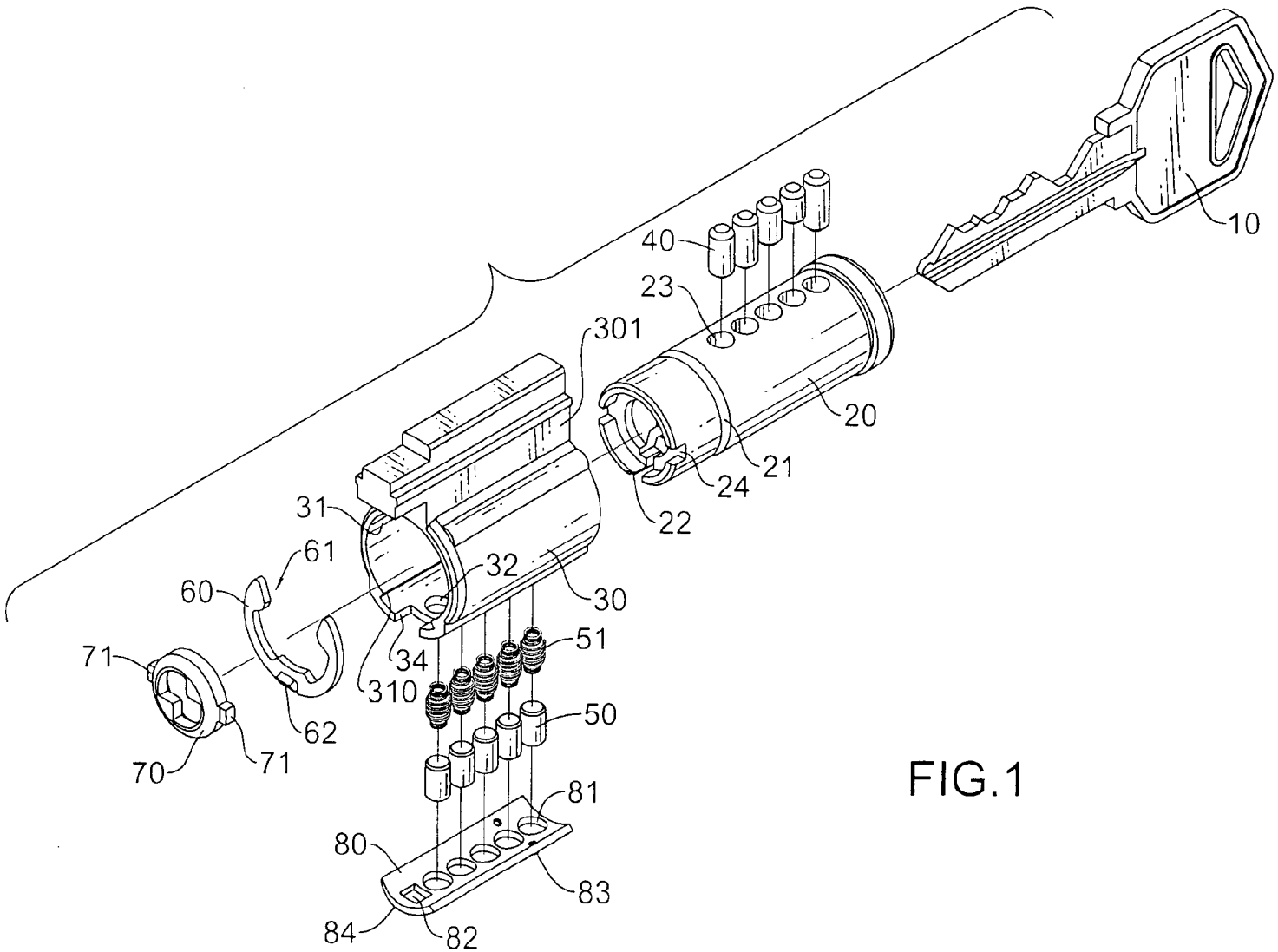
FIG. 1 is an exploded perspective view of a lock set with a quick changeability in accordance with the present invention.
Figure 2:
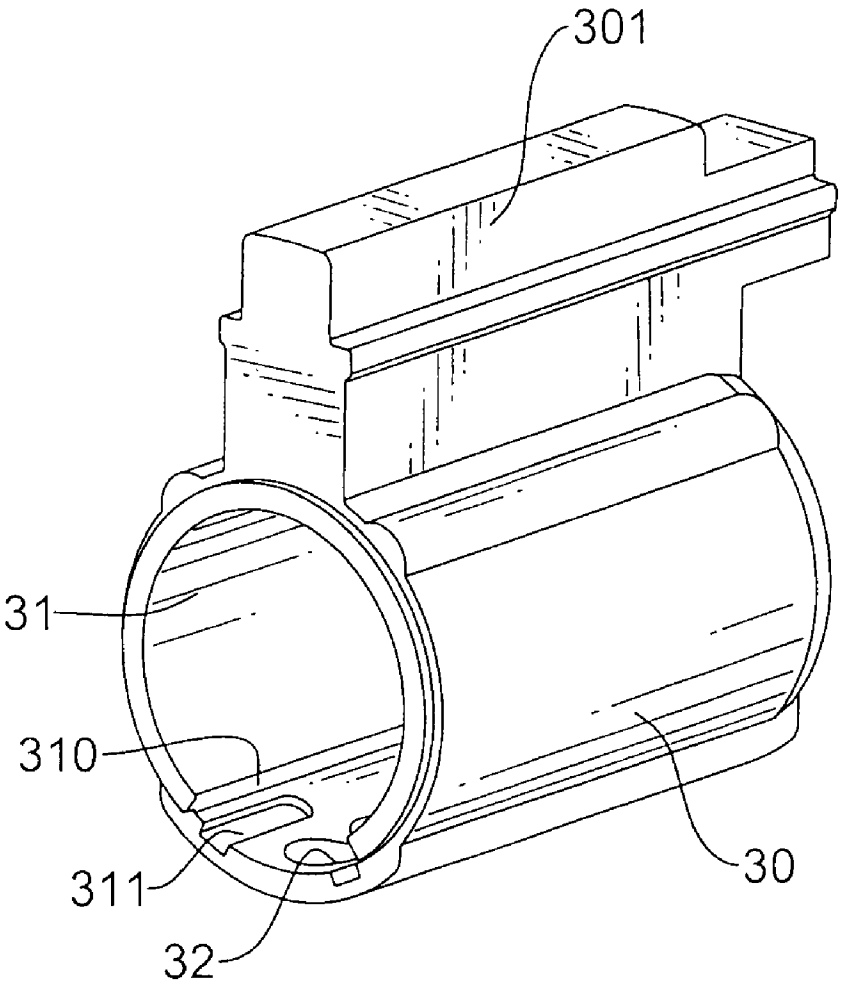
FIG. 2 is a perspective view of a cylinder of the lock set in FIG. 1.
Figure 3:
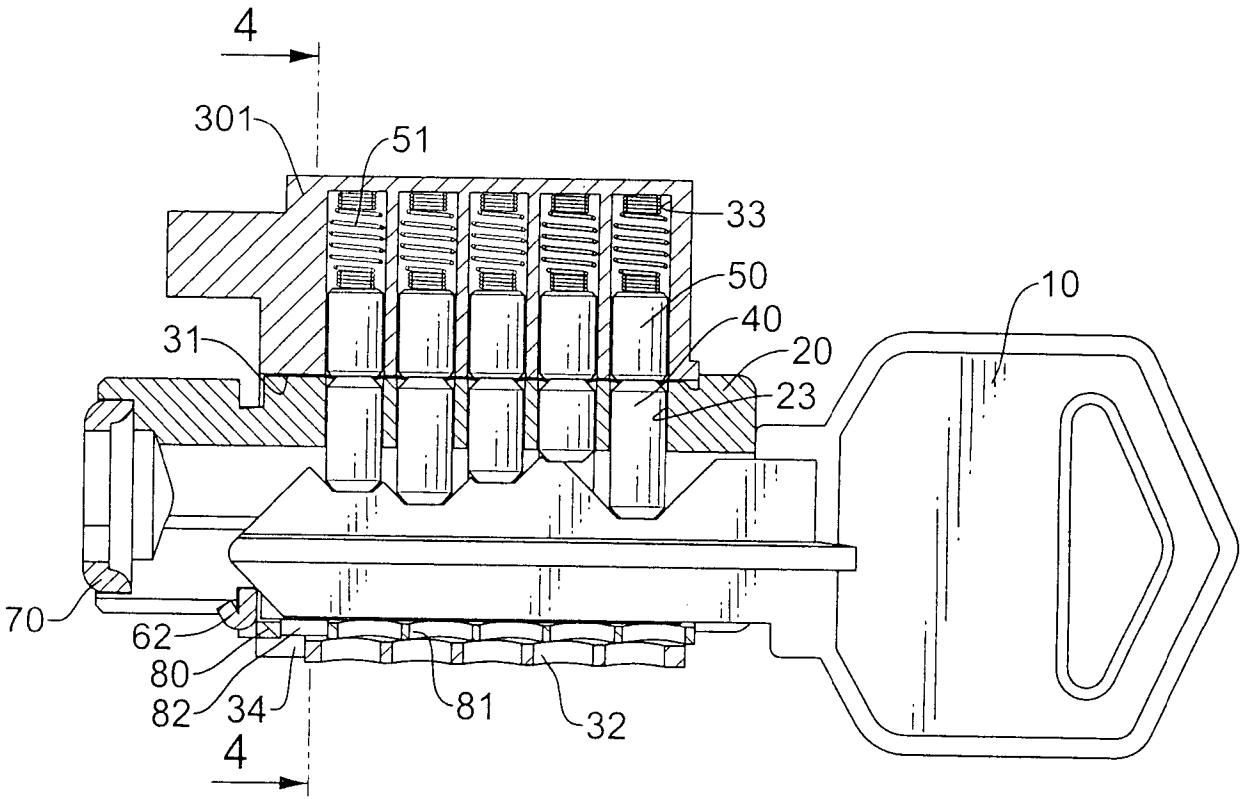
FIG. 3 is a side view in partial section of the lock set with a quick changeability in FIG. 1.

With reference to FIGS. 1–3, a lock set with quick changeability comprises a hollow plug (20), a hollow cylinder (30), a C-shaped ring (60), a seat (70), and a sliding cover (80).

The plug (20) has an annular channel (21) defined in an outer periphery thereof, a key hole defined through the plug (20) and multiple first holes (23) in a row are defined in the outer periphery thereof and communicating with the key hole. Multiple lower pins (40) are inserted respectively into the first holes (23). Two mortises (24) are respectively defined in a rear end of the plug (20) and opposite to each other. A notch (22) is defined in the rear end of the plug (20) and between the mortises (24).

The cylinder (30) has a chamber (31) axially defined therein and a slot (310) is defined in an inner wall thereof. Two grooves (311) are defined in a front end of the slot (310). A cutout (34) is defined in a rear end of the cylinder (30) and multiple openings (32) in a row are respectively defined in the bottom of the slot (310). A lug (301) is radially formed at an outer periphery of the cylinder (30) opposite to the slot (310) and multiple second holes (33) in a row are respectively defined in the lug (301) and in alignment with the openings (32). Multiple upper pins (50) and springs (51) are respectively received into the second holes (33).

The C-shaped ring (60) has an open end (61) and a protrusion (62) formed in a bottom thereof.

The seat (70) has two tenons (71) formed on an outer periphery thereof and opposite to each other.

The sliding cover (80) has multiple orifices (81) in a row defined in an inner surface thereof and an aperture (82) defined in the inner surface thereof and in alignment with the orifices (81). Two stopping posts (83) are formed on an outer surface respectively at two sides thereof and an arcuate edge (84) is formed adjacent to the aperture (82).

For assembling, the plug (20) is mounted in the cylinder (30) and the C-shaped ring (60) is mounted around the channel (21) while the protrusion (62) is inserted into and mated with the notch (22). Hence, the C-shaped ring (60)

can be rotated with the plug (20) and the plug (20) can only rotate in the cylinder (30). The tenons (71) are respectively inserted into and mated with the mortises (24) so that the seat (70) is securely mounted at the front end of the plug (20). The outer diameter of the seat (70) is slightly smaller than the inner diameter of the cylinder (30), and the seat (70) is pressed into the cylinder (30) to keep the seat (70) from escaping from the cylinder (30). The sliding cover (80) is mounted in the slot (310) and the stopping posts (83) respectively mounted in the grooves (311).

Figure 4:
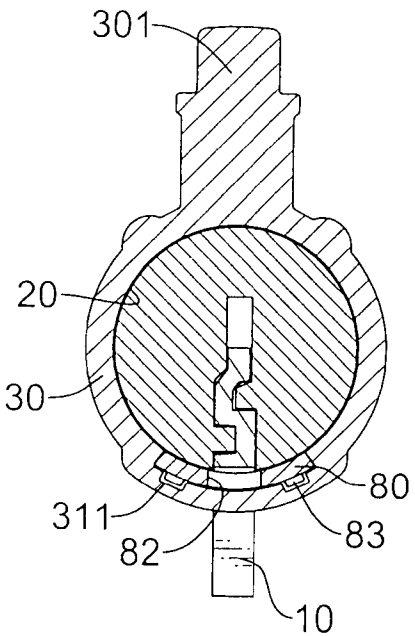
FIG. 4 is a sectional view of the lock set with a quick changeability along line 4—4 in FIG. 3.

With reference to FIGS. 3 and 4, the orifices (81) are deviated from the openings (32) within 1.0 mm in length when the lock set is completely assembled. Hence, the lower pins (40) can not separate from the openings (32) when the plug (20) is rotated to the cylinder (30).

Figure 5:
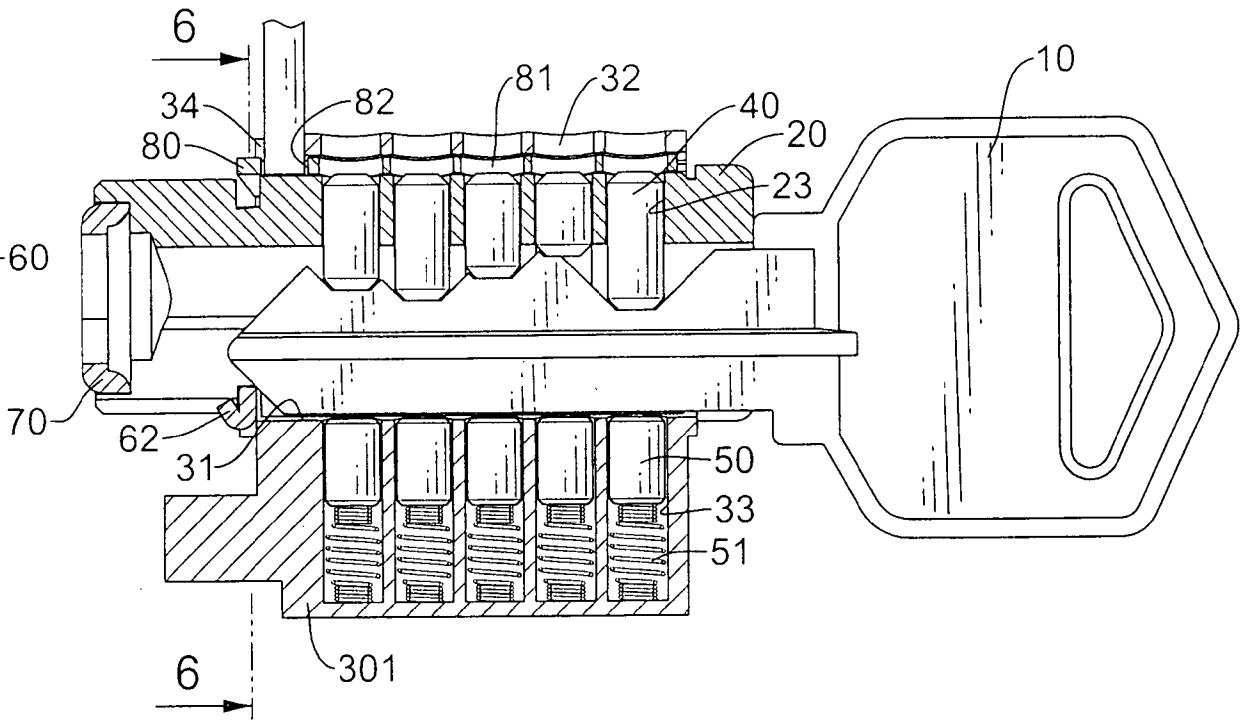
FIG. 5 is an operational side view in partial section of the lock set with a quick changeability in FIG. 1.
Figure 6:
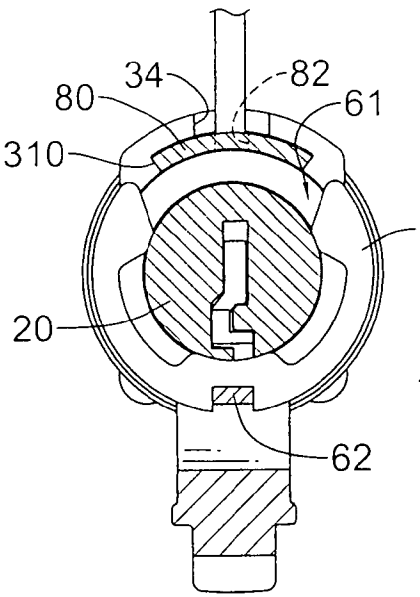
FIG. 6 is a sectional view of the lock set with a quick changeability along line 6—6 in FIG. 5.

With reference to FIGS. 1, 5–6, the key (10) is inserted into the plug (20) to rotate 180 degrees so that the C-shaped ring (60) is driven by the plug (20) and the open end (61) aims to the cutout (34). The sliding cover (80) is pushed to move along the slot (310) via the aperture (82) being pushed by a tool. Due to the stopping posts (83) being inserted into the groove (311), the sliding cover (80) can only move along the slot (310) and not separate from the cylinder (30). When the openings (32) aim to the orifices (81), the lower pins (40) can be taken out of the plugs (20) for renewing and the key (10) can also be changed. When new lower pins are inserted into the plug (20), the C-shaped ring (60) is rotated 180 degrees to resume the sliding cover (80) to an original position via the arcuate surface (84) being pushed. Hence, the openings (32) are respectively deviated from the orifices (81) to prevent the lower pins (40) from separate from the cylinder (30).

It is to be understood, however, that even though numerous characteristics and advantages of the present invention have been set forth in the foregoing description, together with details of the structure and function of the invention, the disclosure is illustrative only. Changes may be made in details, especially in matters of shape, size, and arrangement of parts within the principles of the invention to the full extent indicated by the broad general meaning of the terms in which the appended claims are expressed.

What is claimed is:

1. A lock set with a quick changeability comprising:

a hollow plug having an annular channel defined in an outer periphery thereof, a key hole defined through the plug, and multiple first holes in rows respectively defined in the outer periphery thereof and communicating with the key hole, wherein multiple lower pins are respectively inserted into the first holes, and a notch defined in a rear end thereof;

a cylinder mounted around the plug and having a chamber axially defined therein, a slot with a bottom defined in an inner wall of the cylinder and in communication with the chamber, multiple openings in rows respectively defined in the bottom of the slot, a cutout defined in a rear end of the cylinder, and a lug formed in an outer periphery of the cylinder and having multiple second holes in rows respectively defined in the lug and in communication with the chamber and aimed to the openings wherein multiple upper pins and springs are respectively inserted into the second holes;

a ring mounted around the annular channel and having an open end, and a protrusion formed in a bottom of the ring, wherein the protrusion is inserted into and mated with the cutout so that the ring can be rotated with the plug;

a sliding cover mounted in the slot and having multiple orifices in rows respectively defined in the sliding cover, and an aperture defined in the sliding cover and in alignment with the orifices; and a seat mounted at the rear end of the plug.

2. The lock set with quick changeability as claimed in claim 1, wherein two grooves are defined in a rear end of the slot, multiple stopping posts are respectively formed in an outer surface of the sliding cover and inserted respectively into the grooves.

3. The lock set with quick changeability as claimed in claim 1, wherein the sliding cover has an arcuate edge formed adjacent to the aperture.

4. The lock set with quick changeability as claimed in claim 1, wherein two mortises are respectively defined in the rear end of the plug and opposite to each other, and two tenons are formed on an outer periphery of the seat and mated respectively with the mortises.

5. The lock set with quick changeability as claimed in claim 1, wherein the first holes, the second holes, and the openings are respectively defined in a row.

* * * * *